US006969816B2

(12) United States Patent
Bach et al.

(10) Patent No.: US 6,969,816 B2
(45) Date of Patent: Nov. 29, 2005

(54) SWITCHING ARRANGEMENT FOR LOW-VOLTAGE CIRCUIT BREAKERS

(75) Inventors: Michael Bach, Berlin (DE); Detlev Schmidt, Berlin (DE); Michael Sebekow, Berlin (DE); Günter Seidler, Berlin (DE); Ingo Thiede, Berlin (DE); Sezai Türkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/473,971

(22) PCT Filed: Mar. 12, 2002

(86) PCT No.: PCT/DE02/00935

§ 371 (c)(1),
(2), (4) Date: Oct. 3, 2003

(87) PCT Pub. No.: WO02/082482

PCT Pub. Date: Oct. 17, 2002

(65) Prior Publication Data

US 2004/0094513 A1 May 20, 2004

(30) Foreign Application Priority Data

Apr. 4, 2001 (DE) ..... 101 17 844

(51) Int. Cl.[7] ..... H01H 77/00

(52) U.S. Cl. ..... 218/32; 218/22; 200/244; 335/16

(58) Field of Search ..... 218/6, 14, 16–22, 218/32, 153, 154; 200/244; 335/16, 192, 194, 195

(56) References Cited

U.S. PATENT DOCUMENTS 5,210,385 A 5/1993 Morel et al.
5,874,699 A * 2/1999 Beck et al. ..... 200/244
5,898,146 A * 4/1999 Beck et al. ..... 200/401
5,994,988 A * 11/1999 Ferree et al. ..... 200/244
6,005,206 A * 12/1999 Rakus et al. ..... 218/20
6,376,788 B1 * 4/2002 Jones et al. ..... 218/32

FOREIGN PATENT DOCUMENTS

| | | |
|---|---|---|
| DE | 19727696 | 12/1998 |
| DE | 20100490 | 5/2001 |
| EP | 0410902 | 7/1990 |
| EP | 0853326 | 12/1997 |
| EP | 0955658 | 5/1999 |

* cited by examiner

*Primary Examiner*—Elvin Enad
*Assistant Examiner*—M. Fishman
(74) *Attorney, Agent, or Firm*—Harness, Dickey & Pierce, P.L.C.

(57) ABSTRACT

A switching arrangement for low-voltage circuit breakers with a high nominal current includes movable switching contacts arranged essentially on a moveable contact carrier. It further includes fixed switching contacts and a device for cooling, de-ionizing and extinguishing an electric switching arc. The fixed contact is provided with a pre-contact function over the entire contact width thereof. Moveable contact levers are arranged according to a set pattern in a distributed manner over the entire width of the contact carriers and are provided with or without a pre-contact. A contact lever with a pre-contact and a contact lever without a pre-contact can be provided successively. Similarly, two or more contact levers with a pre-contact and two or more contact levers without a pre-contact can be successively and alternatingly provided in packet-form.

7 Claims, 2 Drawing Sheets

SWITCHING ARRANGEMENT FOR LOW-VOLTAGE CIRCUIT BREAKERS

This application is the national phase under 35 U.S.C. § 371 of PCT International Application No. PCT/DE02/00935 which has an International filing date of Mar. 12, 2002, which designated the United States of America and which claims priority on German Patent Application number DE 101 17 844.1 filed Apr. 4, 2001, the entire contents of which are hereby incorporated herein by reference.

FIELD OF THE INVENTION

The invention generally relates to a switching arrangement for low-voltage power (circuit) breakers. Preferably, it relates to one having a high rated current which essentially has moveable switching contacts arranged on a moveable contact support, stationary switching contacts and a device for cooling, deionizing and quenching the switching arc.

BACKGROUND OF THE INVENTION

Low-voltage power breakers having a high rated current have, by virtue of their operation, a very wide contact system. This is dependent on the continuous current of the breaker and not on its switching capacity, which is generally the same for all breakers, independently of their rated current, and is approximately a maximum of 100 kA. The bar cross section and thus also the width of the busbars and of the contact system are therefore based on the continuous current.

With contact systems of this type, the moveable contacts are in the form of multiple-contact systems with a certain number of identical contact levers. These contact levers are conventionally provided not only with their main contact but also with a primary arcing contact and an arcing horn. This configuration causes the current to be commutated when the moveable switching contact is lifted off, and thus causes the current to be transferred from the main contact to the primary arcing contact. This results in the continuous current producing little heat, since the continuous current is passed through the main contacts, which interact with the stationary opposing contacts of the breaker and are not stressed due to arcs during switching. These main contacts do not erode and they therefore retain a good surface, for which reason their contact resistance and thus the increase in temperature owing to the continuous current are low.

With power breakers to be subjected to high and very high stress levels, for example with current-limiting power breakers, owing to the large number of contact levers provided and their pressure forces, considerable forces act on the contact support, in particular also on the mounting of the contact levers in the contact support, as a result of which, in some circumstances, the stress limits for the material are soon reached. It is therefore desirable to reduce the sum of the contact forces of all of the contact levers, arranged on a hinge pin, on the contact support. With the known, conventional low-voltage power breakers it is therefore usual to arrange a primary arcing contact on the stationary contact side, said primary arcing contact, owing to its dimensions, allowing only a certain number of contact levers of the moveable contact to come into contact with it. This stationary primary arcing contact is, in the case of conventional low-voltage power breakers, narrower than the main contact and is arranged centrally with respect to the entire contact width.

Such an arrangement is described, for example, in EP 0 410 902 B1. Here, a low-voltage power breaker having a moveable multiple contact for high rated currents is shown, which has two or more contact fingers of equal length which are arranged at a small distance from, and parallel to, one another, and a stationary main contact which interacts with a moveable main contact of each individual contact finger in the switched-on position. Furthermore, at least one moveable arcing contact is provided, and is arranged between the end of at least one contact finger and the moveable main contact.

These moveable arcing contacts interact with a stationary arcing contact which is designed such that the arc is centered in relation to the central axis of the switching pole. Thus, as can be seen in particular in FIG. 2 of the patent specification, it is central and is narrower than the stationary main contact. Other arrangements have moveable contacts where not all of the contact levers are provided with primary arcing contacts. In this case, these contact levers which have not been provided with primary arcing contacts are conventionally on the outsides of the multiple contact. An example of this is the low-voltage power breaker described in DE 197 27 696.

All of these arrangements have the disadvantage that the bending stress on the bearing bolt of the moveable contact levers is particularly high owing to the predominantly central action of forces of the contact levers.

SUMMARY OF THE INVENTION

An object of an embodiment of the present invention is therefore to provide a switching arrangement for low-voltage power breakers. Preferably, it relates to one having a high rated current which reduces the considerable forces on the contact support which are caused by the large number of contact levers provided and their pressure forces, and, in particular, makes it possible to achieve a more uniform distribution of the forces acting on the bearing bolt of the contact levers.

An object may be achieved for a switching arrangement for low-voltage power breakers having a high rated current which essentially has moveable switching contacts arranged on a moveable contact support, stationary switching contacts and a device for cooling, deionizing and quenching the switching arc by a stationary contact, which extends over the entire contact width and has a primary arcing contact function, being provided, and the moveable contact levers with and without a primary arcing contact, in a way which differs from the conventional arrangement, being arranged distributed over the entire width of the contact in a defined sequence, at least one moveable contact lever with a primary arcing contact and at least one moveable contact lever without a primary arcing contact being arranged one after the other in an alternating fashion. Thus the contact levers without a primary arcing contact, which are conventionally only arranged on the outer sides of the moveable switching contacts, are preferably distributed over the entire width of the moveable contact support, i.e. even in the central region. In this case, the contact levers can be arranged such that in each case one contact lever with a primary arcing contact and one contact lever without a primary arcing contact are provided one after the other in an alternating fashion over the entire width of the contact support.

However, the contact levers can also be distributed such that they are provided in sections or in groups by two or more contact levers with a primary arcing contact and two or more contact levers without a primary arcing contact being provided one after the other in an alternating fashion.

The contact levers or the groups of contact levers are advantageously arranged symmetrically such that contact levers without a primary arcing contact are in each case arranged on the outsides of the contact support.

It can be expedient, however, to arrange the contact levers or the groups of contact levers symmetrically such that contact levers with a primary arcing contact are in each case arranged on the outsides of the contact support. This reduces the bending stress and potential bending of the highly stressed bearing bolt of the contact levers or moves this stress away from the central region, and distributes the bending forces more uniformly.

By distributing the effective primary arcing contacts over the width of the contact support in this manner and distributing the switching arc elements in terms of their position in a manner which is dependent on the distribution of the primary arcing contacts, it is possible to divide the entire quenching device into quenching device elements which are arranged next to one another and have two or more base points for the switching arc. This reduces the complexity of the parallel quenching devices in spatially separated units by arranging quenching device elements in a quenching area and minimizes the physical width of the breaker.

BRIEF DESCRIPTION OF THE DRAWINGS

The present invention will become more fully understood from the detailed description of preferred embodiments given hereinbelow and the accompanying drawings, which are given by way of illustration only and thus are not limitative of the present invention, and wherein.

DETAILED DESCRIPTION OF THE PREFERRED EMBODIMENTS

Figure 1:
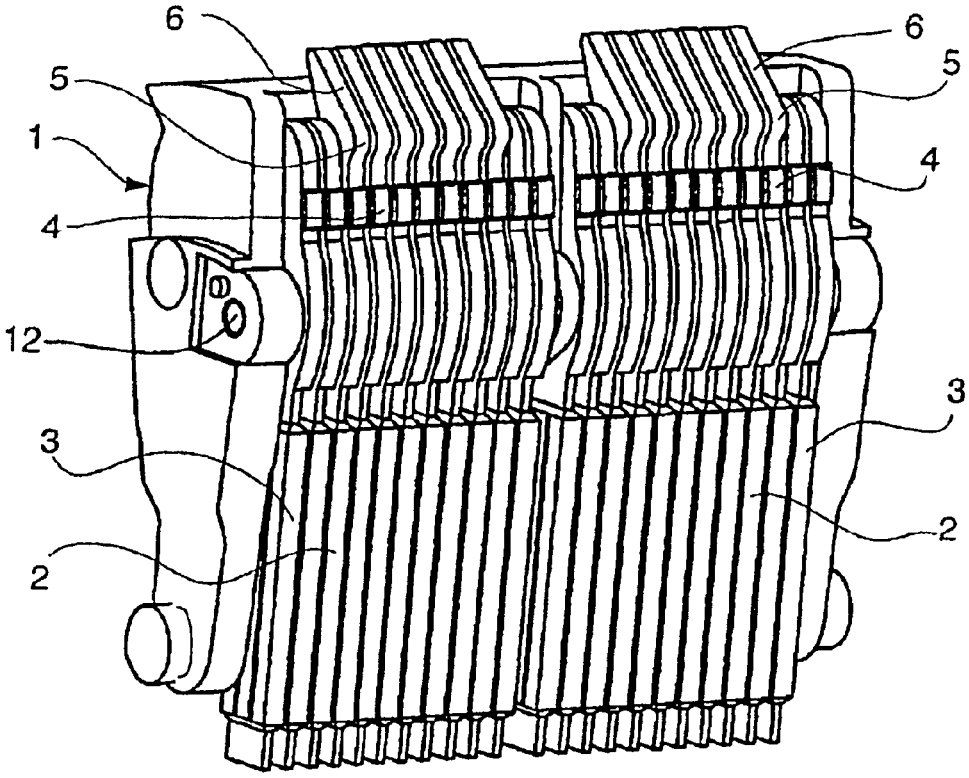
FIG. 1 shows a moveable contact support having a multiple contact and fitted in accordance with an embodiment of the present invention.

FIG. 1 shows a moveable contact support 1 having a multiple contact for a low-voltage power breaker for high rated currents which has two or more moveable contact levers 2, 3 which are arranged at a small distance from, and parallel to, one another. In this case, some of the contact levers 2 have, in addition to the main contact 4, a primary arcing contact 5 which is arranged between the end, which is in the form of an arcing horn 6, of the contact lever 2 and the main contact 4. These moveable primary arcing contacts 5 interact, as do the moveable main contacts 4, in a known manner with stationary primary arcing and main contacts (not shown).

According to an embodiment of the invention, the contact levers 3 which are not provided with primary arcing contacts 5 are arranged in a defined sequence, which differs from the conventional arrangement, limited to the outer regions, and in which they are provided in sections or in groups. In this case, the sequence is not limited to the sequence illustrated in the present example in which, starting from one side of the contact support 1, seven contact levers 2 with a primary arcing contact 5 follow two contact levers 3 without a primary arcing contact 5, followed again by four contact levers 3 without a primary arcing contact, seven contact levers 2 with a primary arcing contact 5 and two contact levers 3 without a primary arcing contact 5. In this case, the different contact levers 2, 3 are arranged symmetrically on the contact support 1 in order to distribute the forces uniformly. This reduces the bending stress and potential bending of the highly stressed bearing bolt 12 of the contact levers 2, 3, or moves this stress away from the central region of the bearing bolt 12 and distributes the acting bending forces more uniformly.

Figure 2:
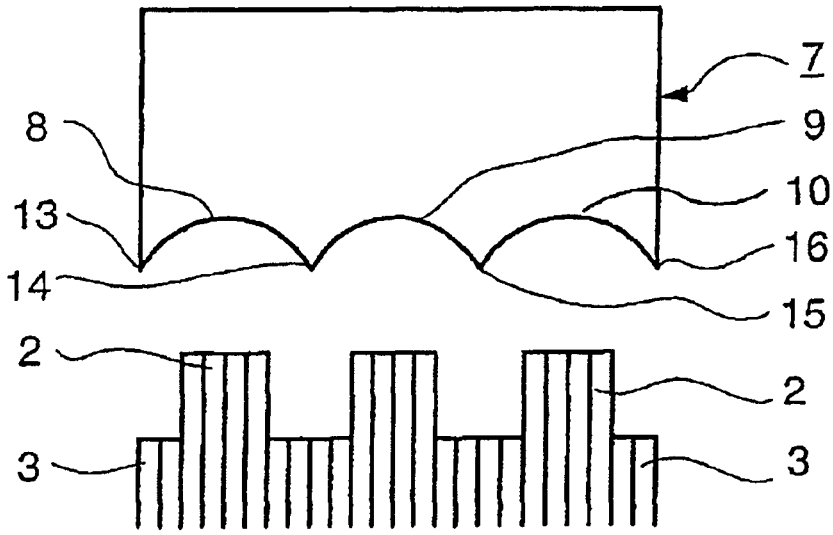
FIG. 2 shows a schematic of a first possible embodiment of the arrangement of the contact levers on the moveable contact support beneath the arc-quenching device.

FIG. 2 shows a schematic of a first possible embodiment of the arrangement of the contact levers 2, 3 of the moveable contact support 1 (not shown) beneath the arc-quenching device 7. In there, the contact levers 2, 3, with or without a primary arcing contact 5, are arranged in groups, in a similar sequence to that shown in FIG. 1.

By distributing the effective primary arcing contacts 5 over the width of the contact support 1 as shown in FIG. 2 and distributing the resulting switching arc elements in terms of their position in a manner which is dependent on the distribution of the primary arcing contacts, it is possible to divide the entire quenching device 7 into quenching device elements 8, 9, 10 which are arranged next to one another and have two or more base points 13, 14, 15, 16 for the switching arc. This reduces the complexity of the parallel quenching devices in the form of spatially separated units by arranging quenching device elements in a quenching area, and minimizes the physical width of the breaker.

Figure 3:
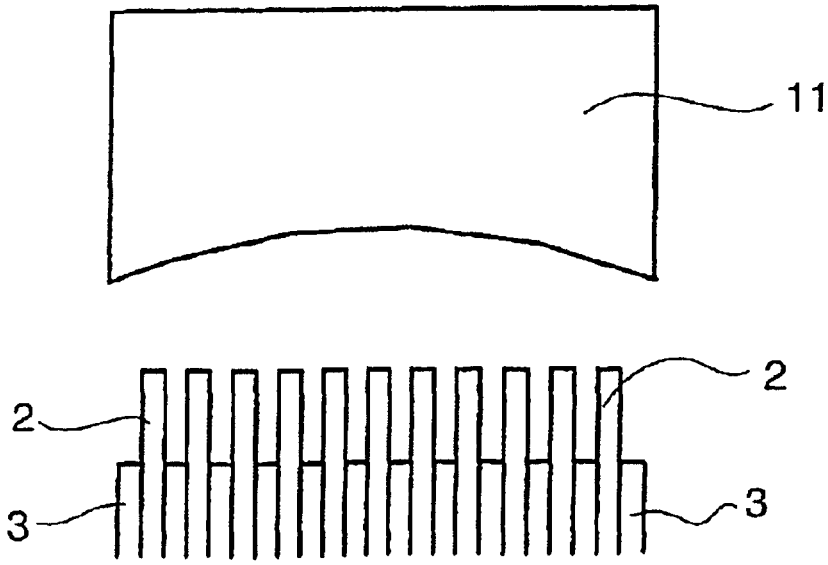
FIG. 3 shows a schematic of a possible variant of the arrangement of the contact levers on the moveable contact support beneath the arc-quenching device.

FIG. 3 shows a schematic of a possible variant of the arrangement of the contact levers 2, 3 of the moveable contact support 1 (not shown) beneath the arc-quenching device 11. In there, as a result, in each case one contact lever 3 without a primary arcing contact 5 and one contact lever 2 with a primary arcing contact 5 are arranged alternately and continuously over the entire width of the contact support 1. This configuration of the arc-quenching device 11 expediently corresponds to the essentially uniform distribution to be expected for the switching arc over the entire switching contact width.

By distributing the different contact levers uniformly over the entire width of the contact support and by reducing the number of contact levers to be provided with primary arcing contacts, this reduction being possible owing to this uniform distribution, the pole reaction is reduced when the contacts first touch, for which reason the required power of the switch-on store can be reduced. This results in all of the mechanical components of the drive system being subjected to less stress or in the mechanical life being extended. By forming the stationary contact over the entire bar width, the increase in temperature owing to the continuous current is positively influenced. The greater amount of copper increases the temperature gradient and thus improves the dissipation of heat. The commutation of the current is considerably improved, which results in the arc-quenching device having a better quenching behavior.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A switching arrangement for low-voltage power breakers, comprising:

a moveable contact support; and a plurality of contact lever stacks arranged on the moveable contact support;

wherein at least two of the contact lever stacks respectively include at least one contact lever with a primary arcing contact;

wherein at least two of the contact lever stacks respectively include at least one contact lever without a primary arcing contact; and wherein the plurality of contact lever stacks are distributed over the entire width of the moveable contact support, such that the contact lever stacks having at least one contact lever with a primary arcing contact and the contact lever stack having at least one contact lever without a primary arcing contact are arranged one after the other in an alternating fashion.

2. A low voltage power breaker comprising the switching arrangement of claim 1.

3. The switching arrangement according to claim 1, wherein the contact lever stacks are arrange symmetrically, such that respectively one contact lever stack with at least one contact lever without a primary arcing contact is arranged on outsides of the moveable contact support.

4. The switching arrangement according to claim 1, wherein the contact lever stacks are arrange symmetrically, such that respectively one contact lever stack with at least one contact lever with a primary arcing contact is arranged on outsides of the moveable contact support.

5. A low voltage power breaker comprising the switching arrangement of claim 3.

6. A low voltage power breaker comprising the switching arrangement of claim 4.

7. The switching arrangement according to claim 1 comprising:

an arc-quenching device in the form of side-by-side arc-quenching devices with a plurality of base points.

* * * * *